United States Patent [19]

Allwein

[11] Patent Number: 4,805,383

[45] Date of Patent: Feb. 21, 1989

[54] BATT PACKAGING MACHINE AND METHOD

[75] Inventor: Robert J. Allwein, Littleton, Colo.

[73] Assignee: Manville Corporation, Denver, Colo.

[21] Appl. No.: 142,592

[22] Filed: Jan. 11, 1988

[51] Int. Cl.[4] ..... B65B 11/08; B65B 63/02

[52] U.S. Cl. ..... 53/528; 53/541; 53/586

[58] Field of Search ..... 53/399, 436, 447, 528, 53/541, 586

[56] References Cited

U.S. PATENT DOCUMENTS

| | | | |
|---|---|---|---|
| 1,190,848 | 7/1916 | Batdorf | 53/528 |
| 3,720,040 | 3/1973 | Rocker | 53/586 X |
| 3,747,295 | 7/1973 | Brinkmeier | 53/528 |
| 4,074,508 | 2/1978 | Reid | 53/528 |
| 4,250,692 | 2/1981 | Vihida | 53/528 |
| 4,466,227 | 8/1984 | Hanscom | 53/528 |
| 4,501,107 | 2/1985 | Piotrowski | 53/541 X |

*Primary Examiner*—John Sipos

*Attorney, Agent, or Firm*—John D. Lister; Cornelius P. Quinn; Gregory A. Evearitt

[57] ABSTRACT

Fiber glass insulation batts are packaged by delivering them to the bottom of a stack of batts, then compressing the stack with a compression plate or platen. The compressed stack is pushed by the platen against a web of packaging film and into a hopper. The web adjacent one side of the stack is then moved over the top face of the stack to enclose it, and is heat welded to the web adjacent the other side of the stack. The web is severed intermediate the weld to separate the package from the web, leaving only a single weld in the package. The stack can be compressed by a dished platen to concentrate the greatest platen pressure at the periphery to avoid damaging the major portion of the surface of the batt contacted by the platen.

6 Claims, 5 Drawing Sheets

FIG. 1
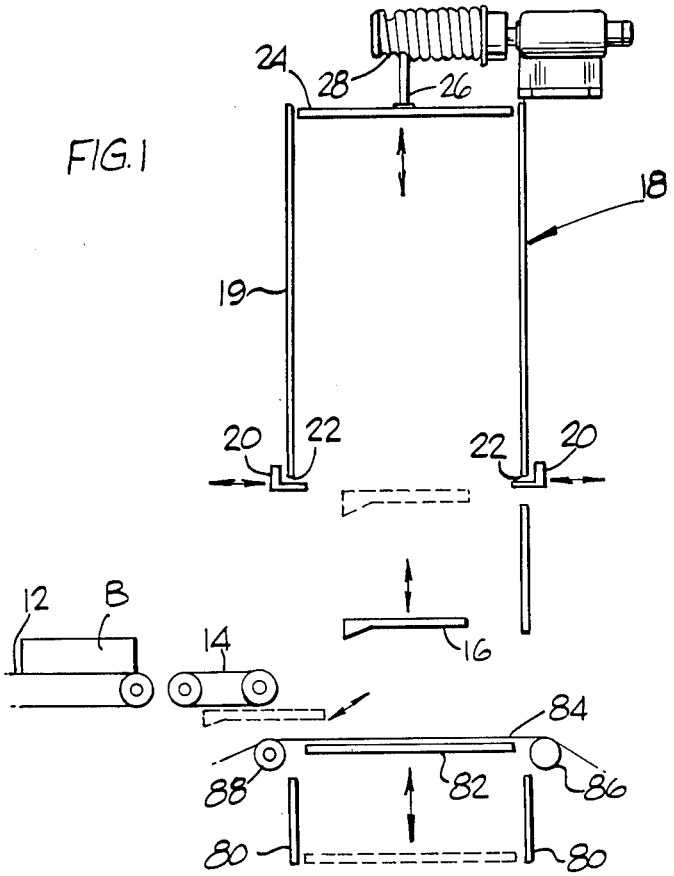
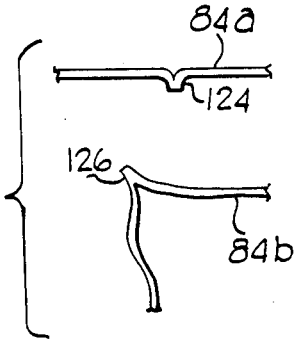
FIG. 6B
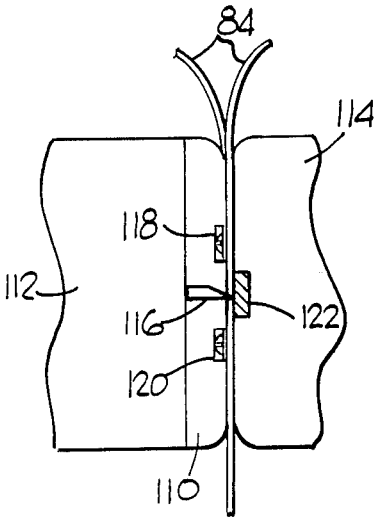
FIG. 6A
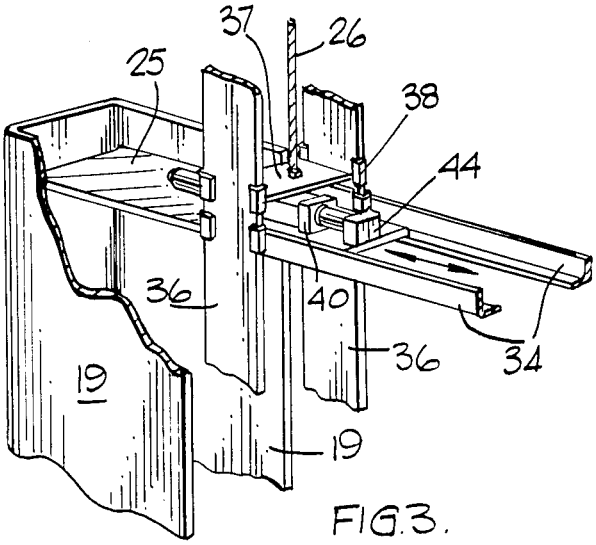
FIG. 3.

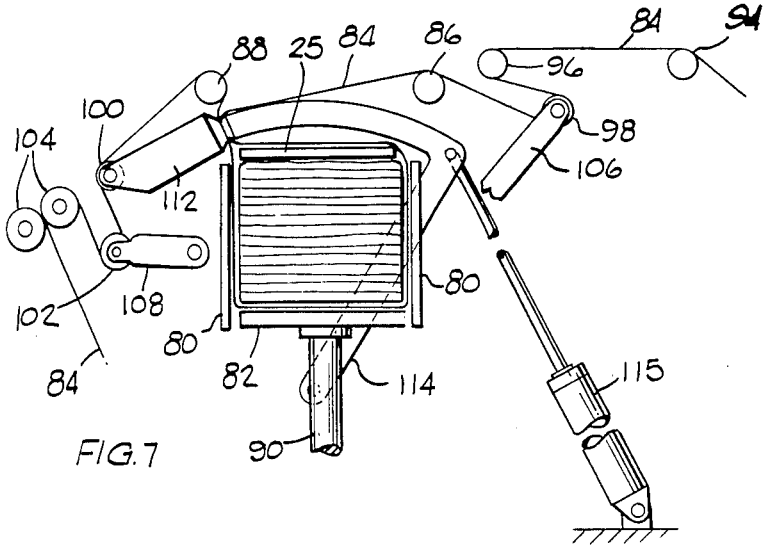
FIG. 7
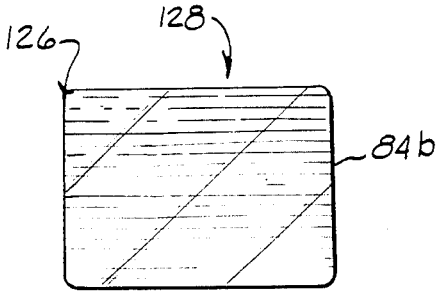
FIG. 9
FIG. 11
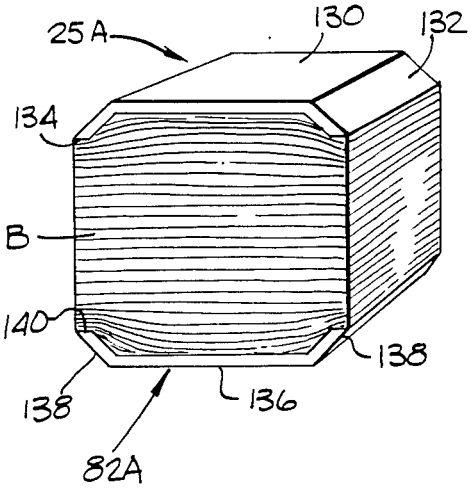
FIG. 10
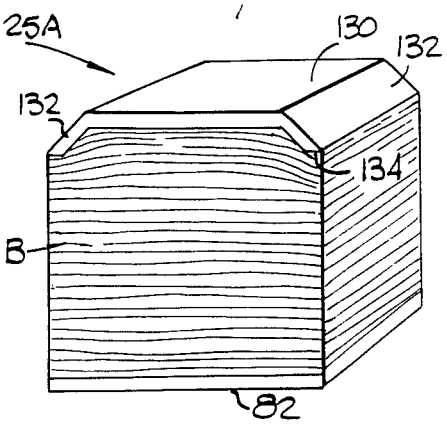

BATT PACKAGING MACHINE AND METHOD

FIELD OF THE INVENTION

This invention relates to the packaging of compressible fibrous insulation batts. More particularly, it relates to a method and machine for automatically forming a package of compressed batts.

BACKGROUND OF THE INVENTION

Fiber glass batts are packaged in a compressed state in order to reduce the size of the package for purposes of warehousing, shipping and handling. The packaging operation, which consists of compressing the batts to their desired thickness and encasing them in plastic or paper wrappers, is a critical process because it can affect the insulating performance of the batts. Proper compression and packaging will allow the batts to spring back to substantially their original thickness when the package is opened. Certain packaging practices, however, reduce the recovery and thereby the insulating performance of the batts. For example, when batts are packaged by moving the compressed batts into premade bags, the deleterious effect of sliding the fibers over a stationary surface damages the outside batts to the point where the batts are not able to recover enough of their thickness when they are removed from their package.

To avoid the problems caused by delivering the batts to premade bags, it has been suggested to form the package around a stack of compressed batts. In one form of such an operation the end of the packaging material has to be rethreaded through the pull rolls each time the material has been wrapped around the batts and severed. This is time consuming and tends to be a bottleneck in the packaging operation, especially in operations utilizing wide packaging film. In another method a stack of compressed batts is pushed against a stationary film which has been fed from and is still attached to a feed roll. The stack moves the film into a recess or hopper on the other side of the film so that the bottom and sides of the stack are covered by the film. The portions of the primary run of film on either side of the top of the stack are then brought together adjacent the top of the stack and heat welded to each other so that the stack is now covered on all sides by packaging film. The weld is then cut so as to sever the film surrounding the batts while still leaving the main web intact. In such an operation, however, the portion of the weld seam remaining in the web becomes a portion of the package covering the next stack of batts, so that each package contains two seams. This is not desirable since the seams represent the weakest part of the package, and the pressure of the compressed batts inside the package can sometimes cause the seams to fail.

Another important element in the packaging of fiber glass batts is the means for compressing the batts. Modern fibers are so resilient that the batts can be greatly compressed for packaging and still recover most of their thickness upon opening of the package. For example, a stack of batts ten feet in cumulative thickness may be compressed to as little as 13 inches in actual practice, and the resulting recovery of thickness is sufficient to allow the batts to function at their rated insulation value. This requires a compression means and a batt delivery means which can function rapidly and efficiently within a limited amount of space without damaging the fibers.

Obviously it would be highly desirable to provide a packaging machine and a package which are not afflicted with the prior art problems enumerated above.

BRIEF SUMMARY OF THE INVENTION

The present invention solves all of the above problems in a unique manner, resulting in a highly efficient automatic batt packaging machine that not only functions without the problems of the prior art, but also produces an improved package containing only a single seam.

A web of packaging material is fed to a position opposite a stack of articles to be packaged, with means for receiving a compressed stack of articles located opposite the web. Platen means are provided to compress the stacked articles and push the compressed stack and the web into the stack receiving means to thereby cause the web to cover the bottom end and two sides of the compressed stack. Means are also provided for moving the web over the uncovered end of the compressed stack to enclose the compressed stack in the web.

Other improvements are also provided. The web is preferably formed of heat sealable material so that the web enclosure can be heat sealed or welded together. Preferably the web is severed at a point intermediate the sealed area to allow both the package and the web to be separate and intact from the other. In addition, the articles may be built up within a vertical tower and fed to the tower by a lifting mechanism adapted to receive batts from an in-feed conveyor and lift them to the bottom of the stack in the tower. A platen for compressing the stack is arranged to be horizontally moved along a platen support so that it can be removed from the compression chamber area, after the compressed batts have been wrapped and the package moved out, and returned to its starting position in readiness for the next stack to be compressed. Further, for reasons to be explained, a dished platen and support plate may be used to reduce the force exerted over the surface of the batts.

Other features and aspects of the invention, as well as its various benefits, will become more clear in the detailed description of the invention which follows.

BRIEF DESCRIPTION OF THE DRAWINGS

FIG. 1 is a diagrammatic front elevation of the packaging machine of the present invention;

FIG. 3 is a partial pictorial view of the top portion of the tower of the packaging machine of FIG. 2, showing the compression plate in its operable position;

FIG. 6A is an enlarged partial sectional view of the welding and cutting heads utilized in the mechanism of FIG. 5;

FIG. 6B is an enlarged partial view of the seams in the packaging film formed by the welding and cutting heads of FIG. 6A;

FIG. 7 is a view similar to that of FIG. 5, but showing the mechanism after it has received a stack of compressed batts and while it is in the process of welding the film;

FIG. 9 is an end elevation of a finished batt package formed by the machine of the present invention;

FIG. 10 is a pictorial view of a dished platen which can be used in producing the package of FIG. 9; and FIG. 11 is a pictorial view of a dished platen and support plate for use in producing the package of FIG. 9.

DESCRIPTION OF THE PREFERRED EMBODIMENT

Figure 2:
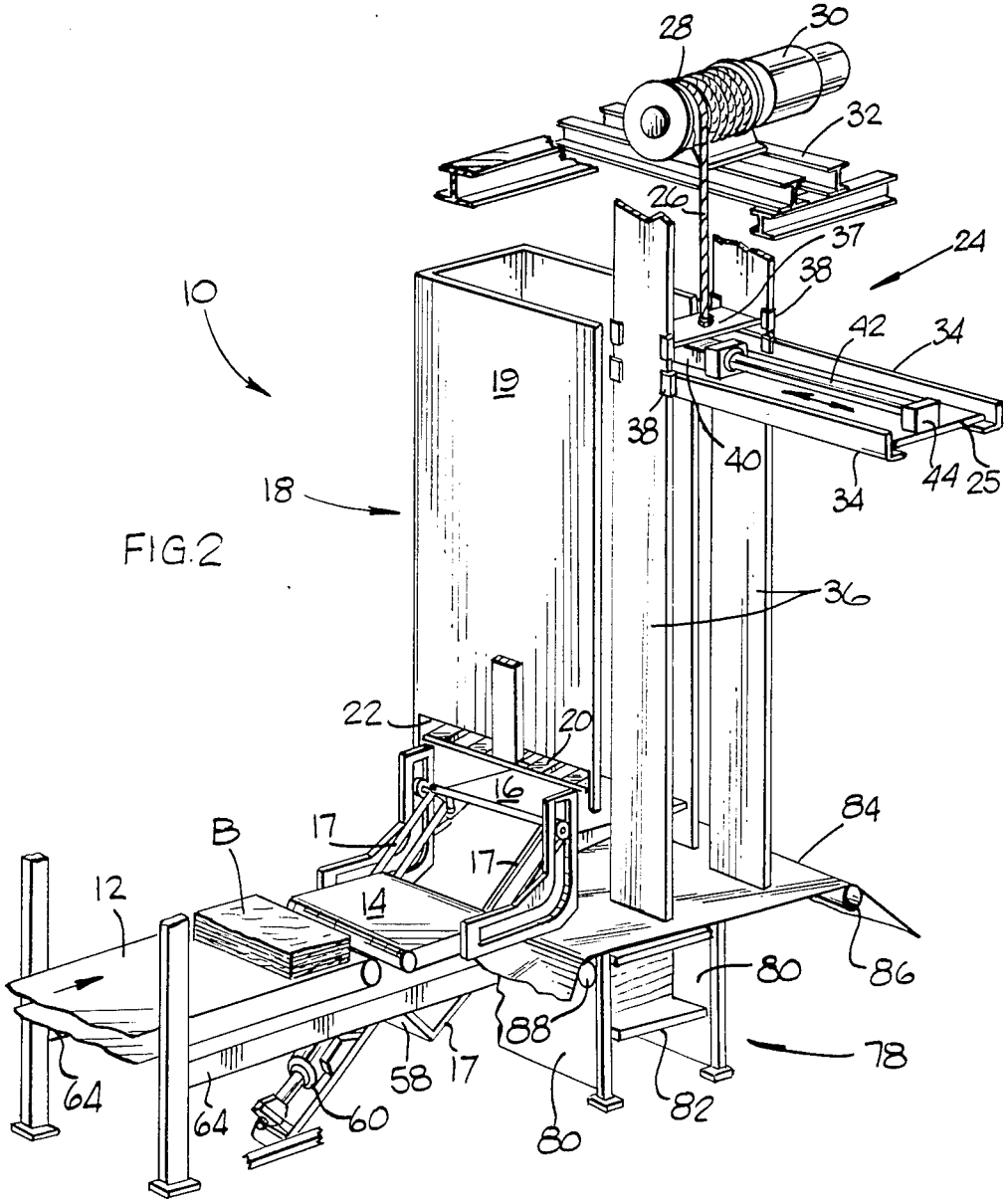
FIG. 2 is a pictorial view of the packaging machine of FIG. 1.

Referring to FIGS. 1 and 2, the packaging machine 10 of the present invention comprises a batt feed conveyor 12 which delivers fiber glass batts B from the fiber manufacturing operation, which is not shown since it does not form part of the invention. Although only a single batt B is shown, it should be understood that the machine can handle a plurality of batts if desired. A speed-up conveyor 14 is positioned downstream from the conveyor 12 so as to receive batts from the conveyor 12 and feed them at a higher speed to a batt lifting tray 16. This allows time for the lifting tray to deliver the batts and return for another load before the next batt arrives on the conveyor. The drives for operating the conveyors at different speeds are well known in the art and accordingly are not shown in the drawing.

The lifting tray 16 is supported by arms 17 designed to impart reciprocal vertical movement to the tray so as to push the batts supported thereon up into a tower 18 beyond the escapements 20. The escapements may take the form of support fingers which are mounted for movement into and out of apertures 22 in the side walls 19 of the tower in timed relationship to the movement of the support tray 16, so as to move out of the tower to make room for the batts being lifted by the tray and to move back into the tower to support the batts as the tray moves down and out of the tower. A compression plate assembly 24, shown at the top of the tower 18, is connected by a cable 26 to a pulley 28 which is operatively connected to a motor 30 mounted on suitable support structure 32.

As shown in FIGS. 2 and 3, the compression plate assembly 24 comprises a compression plate or platen 25 slidably mounted on a support tray 34 which is mounted for vertical movement between spaced columns 36. The cable 26 is attached to a cross support member 37 attached to the tray so that when the pulley is rotated the cable pulls the compression plate assembly up toward the top of the tower. Guide lugs or flanges 38 attached to the support tray 34 engage the edges of the columns 36 to guide the movement of the support tray and allow it to move along the length of the columns without binding. A suitable cylinder 40, preferably a rodless air cylinder, is mounted on the bottom of the cross support member 37 and is connected by piston 42 to a lug 44 attached to the compression plate 25, so that upon actuation of the cylinder the piston will move the plate along the support tray from the position shown in FIG. 2 to the position shown in FIG. 3. The tower is open-ended adjacent the columns 36, and the columns are aligned with the side walls 19 of the tower so that the plate 25 is able to move to the FIG. 3 position wherein a major portion of the plate is in the tower. The purpose of this arrangement will be made clear hereinafter.

Figure 4:
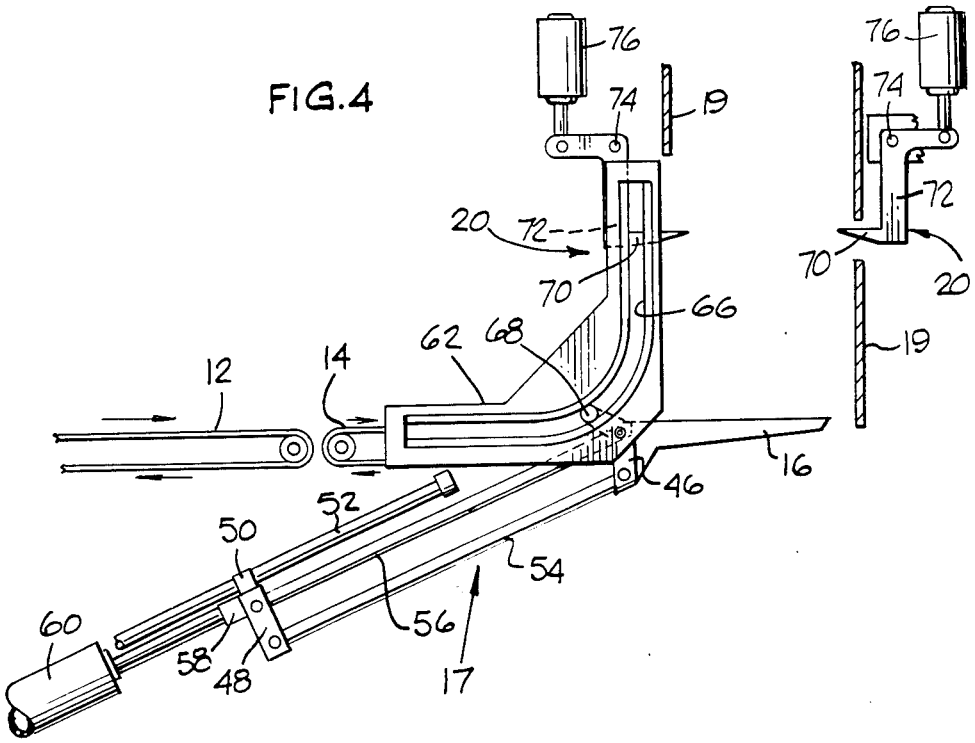
FIG. 4 is a partial elevational view of the packaging machine, showing the batt lifting mechanism of the present invention.

Referring to FIGS. 2 and 4, each of the lifting tray support arms 17 is comprised of leading and trailing plates 46 and 48, respectively. The trailing plates 48 are slidably connected at 50 to support rods 52, and the plates are connected together at their ends by pivotally mounted spaced parallel bars 54 and 56. The trailing plates 48 are connected to each other by a cross bar or plate 58 which is connected to a power cylinder 60, so that upon actuation of the cylinder the plates 48 can be reciprocated along the support rods 52.

Still referring to FIGS. 2 and 4, a cam plate 62 is mounted on each side of the conveyor frame 64 adjacent the end of the conveyor 14. Each cam plate contains a curved cam track 66 having an upstream horizontal extension and a downstream vertical extension. A cam follower 68 attached to each of the leading plates 46 at the upper portion thereof ides in the cam track of the associated cam plate when the cylinder 60 moves the support arm assembly 17. Because of the articulated design of the arm assemblies the bars 54 and 56 will remain parallel to each other regardless of the position of the cam follower 68 in the cam track 66. Thus while the spacing between the bars 54 and 56 will vary depending on the position of the cam follower, the lifting tray 16 will always remain in the same generally horizontal attitude. This arrangement allows the tray 16 to receive a batt fed to it by the conveyor 14, then to be moved outwardly to a position aligned with the tower, then upwardly to push the batt through the open bottom end of the tower. Although a single cylinder 60 is shown for moving the support arm assembly, one or more separate cylinders can be provided, if desired, for moving the assembly first along the horizontal leg of its path and then along the vertical leg of its path.

Although the means for moving the escapements into and out of the tower may comprise any suitable mechanism that produces the desired result, one such means is shown in FIG. 4 to include lower plates or fingers 70 connected to angled supports 72. The supports are pivotally connected at 74 to frame members, not shown, and are pivotally connected at their upper ends to cylinders 76. Actuation of the cylinders will cause the fingers to move into and out of the confines of the tower so as to support the stack of batts in the tower until they are moved out to clear the path for the new batt being pushed into place by the lifting tray 16. The spacing of the escapements, the lifting tray and the batt supported on the lifting tray are such that the lifting tray can move between the escapement fingers 70 but the batt cannot. This arrangement enables the batt which has just been inserted into the tower to be supported by the fingers 70 while the support tray 16 moves past the fingers on its way back down toward the conveyor.

Referring again to FIGS. 1 and 2, a hopper 78 having side walls 80 and open ends is located directly beneath the tower 18. A support plate 82 is mounted for vertical movement within the hopper for a purpose to be explained. A web of film packaging material 84 extends over rolls 86 and 88 in a generally horizontal run the path of which extends between the bottom of the tower and the top of the hopper.

Figure 5:
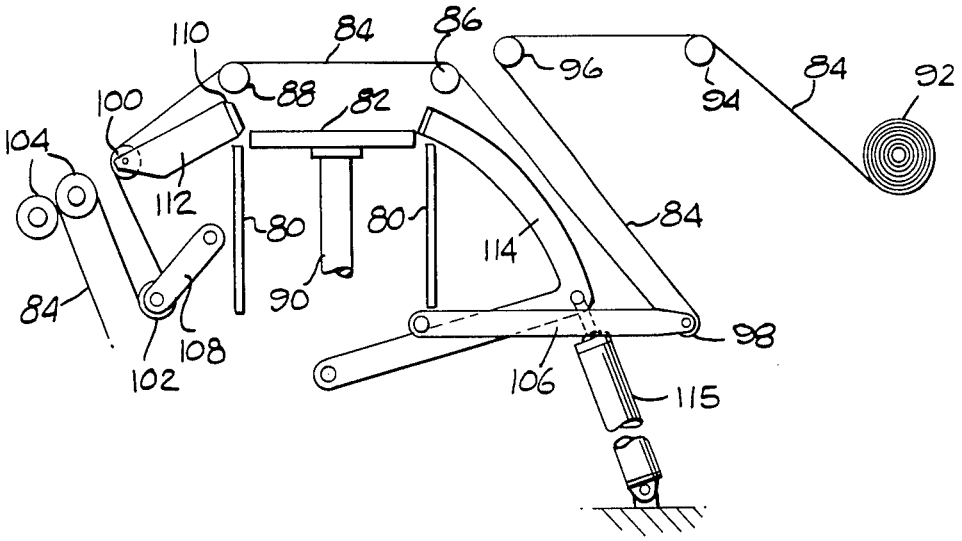
FIG. 5 is a side elevation of the film handling mechanism, including the bottom support table, showing the mechanism ready to receive a stack of compressed batts.

This arrangement is shown in more detail in FIG. 5, wherein the support plate 82 is shown as being attached to the upper end of a pneumatic lift 90 and wherein the web 84 is shown as being drawn from supply roll 92. The web passes over guide rolls 94 and 96 and around take-up roll 98 as it moves over guide roll 86 to a position overlying the support plate 82. Although not shown, it should be understood that a back-up roll and splicing means may also be provided if desired. Beyond the support plate the web passes over guide rolls 88 and 100, and then around take-up roll 102 before entering the nip rolls 104. The take-up rolls 98 and 102 are mounted on the ends of pivotally mounted arms 106 and 108, respectively. In addition, a seal head 110 is positioned on the inwardly directed face of stationary support member 112 just below the guide roll 88, and clamp bar 114 is mounted for movement by cylinders 115 toward and away from the seal head.

As illustrated in FIG. 6A, the clamp bar 114 is adapted to clamp two thicknesses or layers of the web 84 against the seal head 110 during the packaging operation. The seal head carries a cutting blade or wire 116 as well as spaced heating elements 118 and 120. If desired the clamp bar may also carry a cutting block 122 located between the heating elements and aligned with the cutting blade when the clamp bar is engaged with the seal head. When the clamp bar clamps the two thicknesses of film against the seal head the blade or wire severs the layers of web, and at the same time the heating elements melt the layers along their lines of contact to weld the layers together in the form of two seams. As shown in FIG. 6B, when the clamp head is separated from the seal head the remaining layers of web are intact, leaving a single thickness of web **84*a* containing a weld or seam 124 and another single thickness of web 84*b* containing a weld or seam 126. The web 84*a* would correspond to the main web 84 while the web 84*b*** would correspond to the wrapper on the package. The web is not limited to any particular film material, but the film should be of a thermoplastic nature which can be melted upon being exposed to sufficient heat.

Referring to FIGS. 1–4, in operation, batts are fed into the packaging machine on the conveyors 12 and 14 and deposited onto the lifting tray 16. Actuation of the cylinder 60 causes the support arms 17 to move the support tray downstream from the conveyors a distance sufficient to align the tray with the tower, and then up toward the open tower bottom. The escapements 20 are moved out of the tower just as the top of the batt being introduced to the tower comes into contact with the bottom of the lowermost batt in the tower. Continued upward movement of the support tray pushes the batt supported on the tray, as well as the stack of batts above it, farther up into the tower until the bottom of the batt on the tray has moved up beyond the space normally occupied by the escapements. The escapements are then returned to their normal position and the tray is moved down as a result of the cylinder 60 being reversed. Due to the dimensions of the various elements, the tray can move past the closed escapements but the batts cannot, thus allowing the tray to move back down while the stack of batts is retained in the tower. This procedure is repeated until the stack of batts reaches a predetermined count in the tower.

At this point the pulley 28 is disengaged from the motor 30 and the support tray 34 is free to drop down, guided by the support columns 36. Because the compression plate 25 extends into the tower, in the manner shown in FIG. 3, it contacts the top of the stack of batts and compresses the stack as both the compression plate and the support tray 34 move down. It will be understood that at this time the escapements will again have opened so as not to interfere with the downward movement of the batts. Due to the weight of the compression plate, the support tray and the various other equipment and elements carried by the support tray, the stack of batts is readily compressed to a small fraction of its uncompressed height.

Figure 8A:
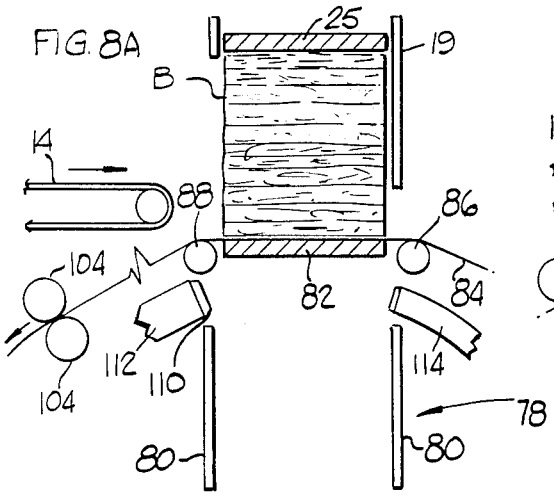
FIGS. 8A–8F are diagrammatic side elevations of the compression plate, packaging film and hopper, sequentially illustrating the formation of a package in accordance with the present invention.
Figure 8B:
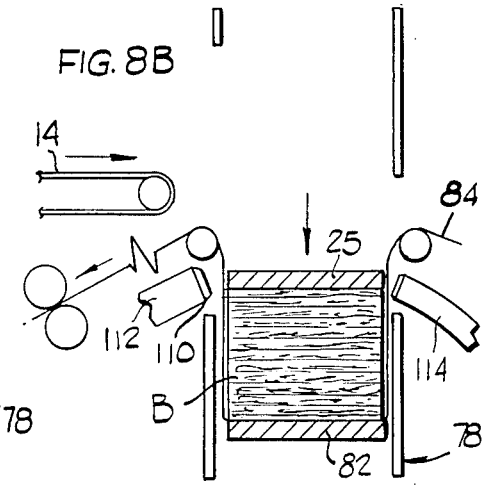
Figure 8C:
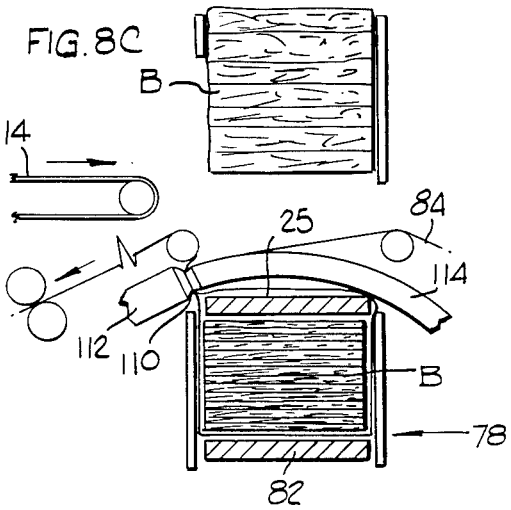

Referring to the sequence of operations illustrated in FIGS. 8A–8F, at one point in the batt compression operation, as shown in FIG. 8A, the batts will have been compressed a substantial amount between the compression plate 25 and the support plate 82. Note that the web 84 extends between the bottom batt and the support plate 82. Further downward movement of the compression plate 25 transmits sufficient force through the compressed stack of batts to overcome the pneumatic resistance of the support plate mounting means, causing the support plate 82 and the batts to be pushed down into the hopper 78, as shown in FIG. 8B. At the bottom of the compression plate stroke the batts will have been compressed even more as the full force of the compression plate is exerted until it comes to rest. At this stage the film will have been drawn down into the hopper so that the bottom and two sides of the package will have been formed.

When the support plate is moved downward by the force of the falling compression plate assembly the sudden downward pull on the web 84 causes the take-up rolls 98 and 102, shown in FIG. 5, to pivot up to supply the extra amount of web needed to form the sides of the package. This position of the take-up rolls is shown in FIG. 7, wherein the support plate 82 has been pushed down to its lowermost position and the compression plate or platen 25 has fully compressed the batts. The clamp bar 114 is shown in engagement with the seal head 110 and will have been moved to that position by the cylinders 115 immediately after the platen 25 has reached the bottom of its downward travel. This phase of the operation is also shown diagrammatically in FIG. 8C. As shown in both FIG. 7 and FIG. 8C, the clamp bar 114 has pushed the web over to the seal head 110, thereby moving the packaging film over the top of the compressed batts, which completes the wrapping of the batts. The welding and cutting of the film takes place as described previously, resulting in the web now containing a seam and the package wrapper also containing a seam.

At this point in the sequence an ejection cylinder, not shown, is acutated to push the compressed batts and the tube of wrapping material formed from the web out an open end of the hopper. The resiliency of the batts causes the batts to expand to a degree upon being freed from the upper confines of the hopper so that they immediately take up the space formerly occupied by the pressure plate. This results in a tight fit of the wrapper and establishes the final dimensions of the package. The cylinder 40 is then actuated to slide the platen 25 to the outer end of the support tray 34, at which time the pulley 28 lifts the platen assembly back to its uppermost position. It should be noted in FIG. 8C that as soon as the platen has reached its lowermost position, and while the web sealing operation is taking place, new batts are again loaded into the tower in preparation for the next compression cycle.

Figure 8D:
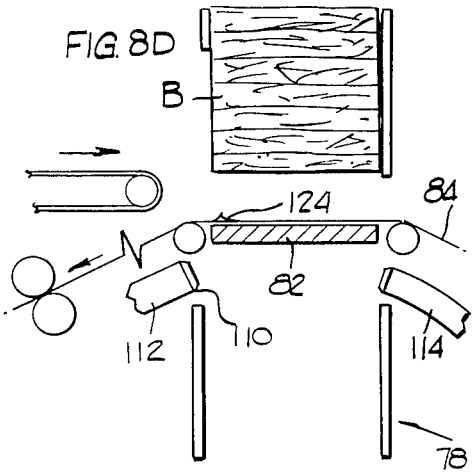
Figure 8E:
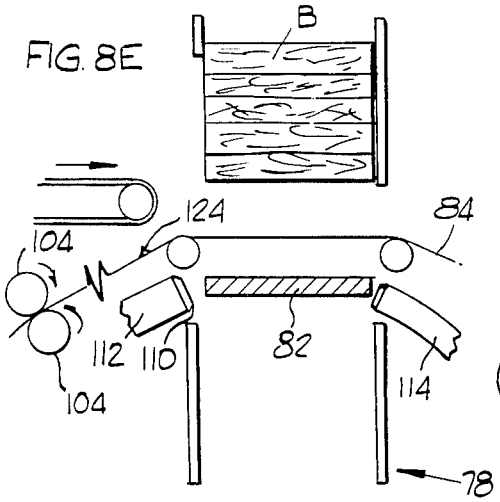
Figure 8F:
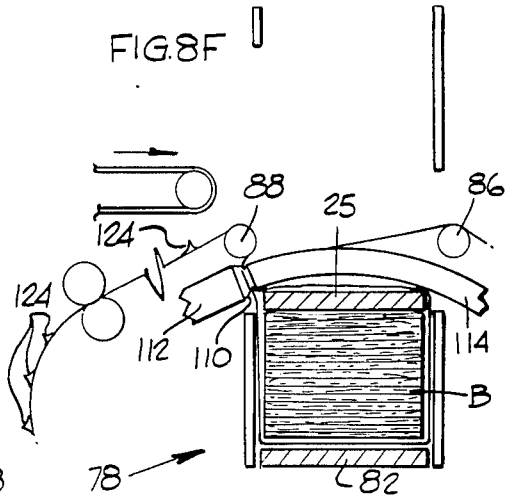

Referring to FIG. 8D, which shows the packaging section awaiting delivery of the next stack of batts, it can be seen that the seam 124 in the web 84 resulting from the welding and cutting operation is located so that it would be in the wrapper of the next package to be formed. This would mean that the next package would contain two weld seams, which is undesirable since the seams represent the weakest part of the wrapper. In order to limit the package to a single seam the nip rolls 104 are actuated, as shown in FIG. 8E, to advance the web a distance sufficient to move the seam beyond the point where it would be incorporated in the next package. This step when repeated for each cycle of the operation produces a series of closely spaced seams 124 which, as shown in FIG. 8F, are simply fed to scrap.

As illustrated in FIG. 9, the operation described produces a package 128 consisting of a stack of highly compressed batts B covered on four sides by a film wrapper 84B containing a single weld seam 126. The package is of conventional, generally rectangular, cross-sectional shape as a result of being formed in the chamber shown in FIGS. 1, 7 and 8A–8F, which is comprised of straight side walls 80, a flat support plate 82 and a flat compression plate or platen 25. It is a highly functional package due to the greatly reduced thickness of the compressed batts, allowing a maximum amount of insulation material to be contained in a relatively small package. In creating the package, however, it is necessary to compress the batts to a smaller combined height than the desired height of the finished package in order to compensate for spring-back of the resilient fibers. The amount of spring-back would of course vary with the specific fibers involved. In the case of a batt of highly resilient glass fibers, for example, it was found necessary to compress the stack of batts to about two-thirds of the ultimate height of the package. Thus a desired package height of 20" required the batts to be compressed to a height of about 14". The great pressures exerted on the outer batts by the hard surfaces of the support plate and the platen in achieving such levels of compression, however, can tend to damage the fibers in these batts.

It has been found, surprisingly, that the problem of fiber damage can be substantially reduced by utilizing a dished instead of a flat platen. This arrangement is shown in FIG. 10, wherein a platen 25A comprises a flat central or intermediate portion 130 and opposite peripheral or edge portions 132 angled downwardly from the flat portion. As illustrated in FIG. 10, the lowermost edges 134 of the edge portions 132 compress the batts B to a greater extent than the flat portion 130 does, resulting in the fibers which have been compressed by the edges 134 springing back a greater amount than the fibers compressed by the flat portion 130. It is thereby possible to dimension the dished platen 25A so that the opposite edge portions of a stack of batts compressed by the edge portions 132 of the platen 25A will spring back to substantially the same level as the central portions of the stack which have been compressed by the flat portion 130 of the platen 25A. In this manner only the fibers in the outer batts which are contacted by the edges 134 will be damaged to the same extent as the fibers across the entire face of the outer batts were damaged when compressed by a flat platen.

As shown in FIG. 11, in addition to using a dished platen, the support plate 82A may be similarly dished so as to comprise a flat central portion 136, angled edge portions 138 and edges 140. This arrangement functions similarly to that of FIG. 10, but results in even less compression of the fibers in the central portion of the package. The advantage of such an arrangement can readily be seen by comparing the amount of compression required to create a package of the same dimensions as those described above in connection with the use of a flat platen and support plate. To create a package having a height of 20", the flat portions 130 and 136 can be spaced apart 16", with only the edges 134 and 140 spaced the original distance of 14". Thus for much of the expanse of the outer batts they would have to be compressed to only 80% of the final package height instead of 67%.

It should now be clear that the present invention results in an improved automatic packaging operation and an improved insulation package. The batts are fed upwardly into the tower rather than being dropped into a chamber, which prevents the ends of fibers which have been lightly glued for packaging purposes from separating upon impact. This arrangement also eliminates more costly batt feeding equipment, which would be required for delivering batts to the top of a compression chamber, in favor of the simple yet very efficient upstacking mechanism utilized in the packaging machine of this invention.

The batts are compressed by the falling weight of a plate assembly instead of by a power ram, and a unique web wrapping operation not only enables the wrapper to be formed around the batts but does so with continuous control of the film, thus doing away with problems caused by loose ends of film having to be threaded and aligned for each package. The resulting package contains only one weld seam instead of two, thus decreasing a potential point of failure of the wrapper. Further, fiber damage in the compression process can be significantly reduced even though the final package is of the same size and shape as batt packages commonly used in the industry.

It should be understood that the various timed responses of the different components of the machine can be achieved by any desired means. Limit switches mounted for engagement by one or more of the regularly moving parts could, for example, be employed for this purpose.

Although the support plate has been described as being mounted on a pneumatic lift, suitable mechanical means could be used instead, one example being a scissors mounting enabling downward movement in response to force applied by the compression plate.

It should now be obvious that although a preferred embodiment of the invention has been described, changes to certain features of the embodiment may be made without changing the overall operation of the invention and without departing from the spirit and scope of the invention as defined in the claims.

What is claimed is:

1. A machine for packaging compressible articles, comprising:

means for abutting and aligning the articles to form a vertical stack;

means for positioning a web of wrapping material beneath the bottom of the stack;

a support plate beneath the web, the support plate being mounted for vertical movement between an upper position and a lower position and being biased toward the upper position;

means beneath the upper position of the support plate for receiving a compressed stack of articles;

means for compressing the stack of articles against the support plate with sufficient force to overcome the bias of the support plate and push the articles and the support plate into the article receiving means, the web thereby covering the bottom end and two sides of the compressed stack of articles;

means for moving the web over the upper end of the compressed stack to enclose the compressed stack of articles in the web; and wherein the means for forming the stack comprises tower means for holding the stacked articles, a lifting tray for supporting articles thereon, the lifting tray being normally both vertically and transversely spaced from the bottom of the stack at a location outside the tower, means for lifting the lifting tray from outside the tower to within the tower to add articles to the bottom of the stack and to push the stack upwardly during upward vertical movement and to move down and out of the tower during downward vertical movement, and means associated with the tower for supporting the stack of articles within the tower when the lifting tray is not supporting the stack.

2. A packaging machine according to claim 1, wherein the lifting tray is operatively connected to cam means for guiding the movement of the lifting tray, the cam means including a generally horizontal component which guides the movement of the lifting tray along a generally horizontal path outside the tower and a generally vertical component which guides the movement of the lifting tray along a generally vertical path within the tower.

3. A packaging machine according to claim 2, wherein the lifting tray is supported by arm means for maintaining the tray in a generally horizontal attitude, the arm means comprising a linkage in the general shape of a parallelogram.

4. A packaging machine according to claim 1, wherein the means for compressing the articles against the support plate and pushing the articles and the support plate into the article receiving means comprises platen means, the packaging machine further including means for moving the platen means to a position aligned with and above the upper end of the stack of articles and for moving the platen means downwardly, the force and extent of the downward movement of the platen means compressing the articles and pushing the compressed articles and the support plate into the article receiving means.

5. A packaging machine according to claim 4, wherein the platen means comprises a generally horizontal platen support, a platen mounted for movement on the platen support, and means for moving the platen on the platen support from a position aligned with the stack of articles to a position transversely spaced therefrom, so that the platen can compress the stack of articles, be moved to its transversely spaced position and then be moved back to its position aligned with and above the upper end of the stack of articles without traveling through the tower as it is moved vertically upwardly.

6. A packaging machine according to claim 4, wherein the side of the platen contacting the end of the row of aligned articles is dished.

* * * * *